US008500121B1

(12) United States Patent
Paulson et al.

(10) Patent No.: US 8,500,121 B1
(45) Date of Patent: Aug. 6, 2013

(54) DRIVEN NIP ROLLS FOR SHEET STACKER INFEED

(75) Inventors: Richard F. Paulson, Phillips, WI (US); James M. Krog, Phillips, WI (US)

(73) Assignee: Marquip, LLC, Phillips, WI (US)

( * ) Notice: Subject to any disclaimer, the term of this patent is extended or adjusted under 35 U.S.C. 154(b) by 0 days.

(21) Appl. No.: 13/367,783

(22) Filed: Feb. 7, 2012

(51) Int. Cl.
*B65H 5/02* (2006.01)
*B65H 29/20* (2006.01)
*B65H 43/04* (2006.01)

(52) U.S. Cl.
USPC ..... 271/272; 271/69; 271/314; 271/198

(58) Field of Classification Search
USPC ..... 271/272, 69, 314, 198; 198/570, 198/789
See application file for complete search history.

(56) References Cited

U.S. PATENT DOCUMENTS

| | | | | |
|---|---|---|---|---|
| 3,022,999 | A | 2/1962 | Mead | |
| 4,919,414 | A | 4/1990 | Marschke et al. | |
| 5,160,129 | A | 11/1992 | Siriporn et al. | |
| 5,613,673 | A | 3/1997 | Roberts et al. | |
| 6,103,171 | A | 8/2000 | Cummings | |
| 6,145,833 | A | 11/2000 | Rodewald et al. | |
| 6,595,349 | B2 * | 7/2003 | MacSwan | 198/607 |
| 6,883,409 | B1 | 4/2005 | Spix et al. | |
| 2006/0225992 | A1 * | 10/2006 | Tachibana et al. | 198/789 |
| 2008/0237974 | A1 * | 10/2008 | Mandel et al. | 271/226 |

* cited by examiner

*Primary Examiner* — David H Bollinger
(74) *Attorney, Agent, or Firm* — Andrus, Sceales, Starke & Sawall, LLP

(57) ABSTRACT

In a sheet downstacker of a corrugator dry end, sheets are delivered by a drive system driving both the bottom and top nip rolls with a single motor that also drives the last flat belt sheet conveyor to the nip.

13 Claims, 5 Drawing Sheets

DRIVEN NIP ROLLS FOR SHEET STACKER INFEED

BACKGROUND

Corrugated paperboard sheets produced on the dry end of a corrugator are typically shingled and then delivered to a downstacker bay where the sheets are squared in a uniform stack fed by a stacker infeed nip. The sheets exiting the nip and delivered to the stacker descend with the infeed of sheets until a stack of a desired number of sheets or height is achieved whereupon the stack is removed and the stack support is returned to a position adjacent the infeed nip.

Prior art stacker infeed nips have typically used a driven bottom roll and an idler top roll with a cushioning or zero crush cylindrical contact surface.

In stackers utilizing a single bottom drive roll for the infeed nip, "back slip" or shingle compression can occur, particularly if there are quality problems with the sheets being stacked. Back slip or shingle compression may result in the buildup of too much pressure in the nip and can result in product jam. Poor product quality may also cause a jam at the stacker infeed nip. When this occurs, cross machine direction slip of the sheets entering the stacker bay is also a problem.

SUMMARY

It has been found that driving the top nip roll in synch with the driven bottom nip roll can avoid all of the foregoing problems. The driven top nip roll prevents back slip under heavy drive conditions as the shingle is driven from both the top and the bottom. This also addresses and alleviates the problem of cross machine direction slip which, as indicated, reduces stack quality. Finally, a lower nip force is sufficient to adequately handle the shingle of sheets being delivered to the downstacker which further minimizes the chances of board crush.

DETAILED DESCRIPTION

Figure 1:
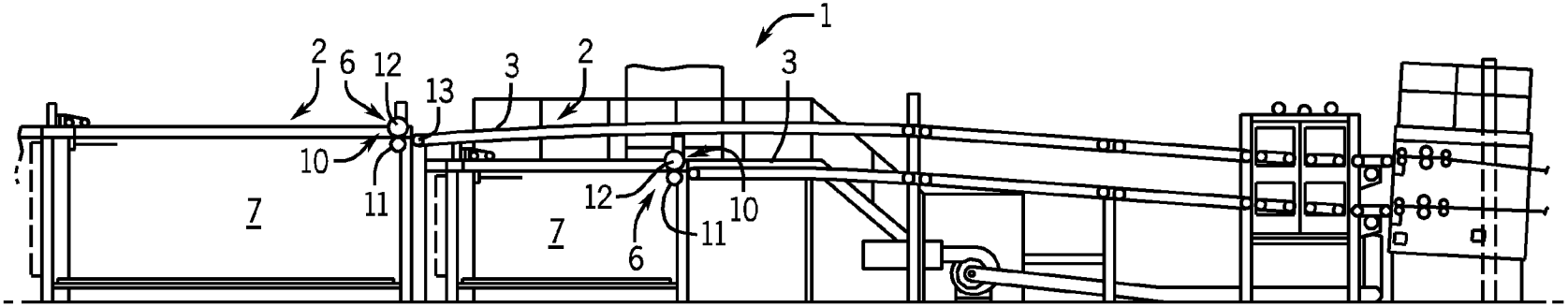
FIG. 1 is a schematic side elevation of a portion of a corrugator dry end showing the positioning of the new nip roll drive system of the present invention.
Figure 2:
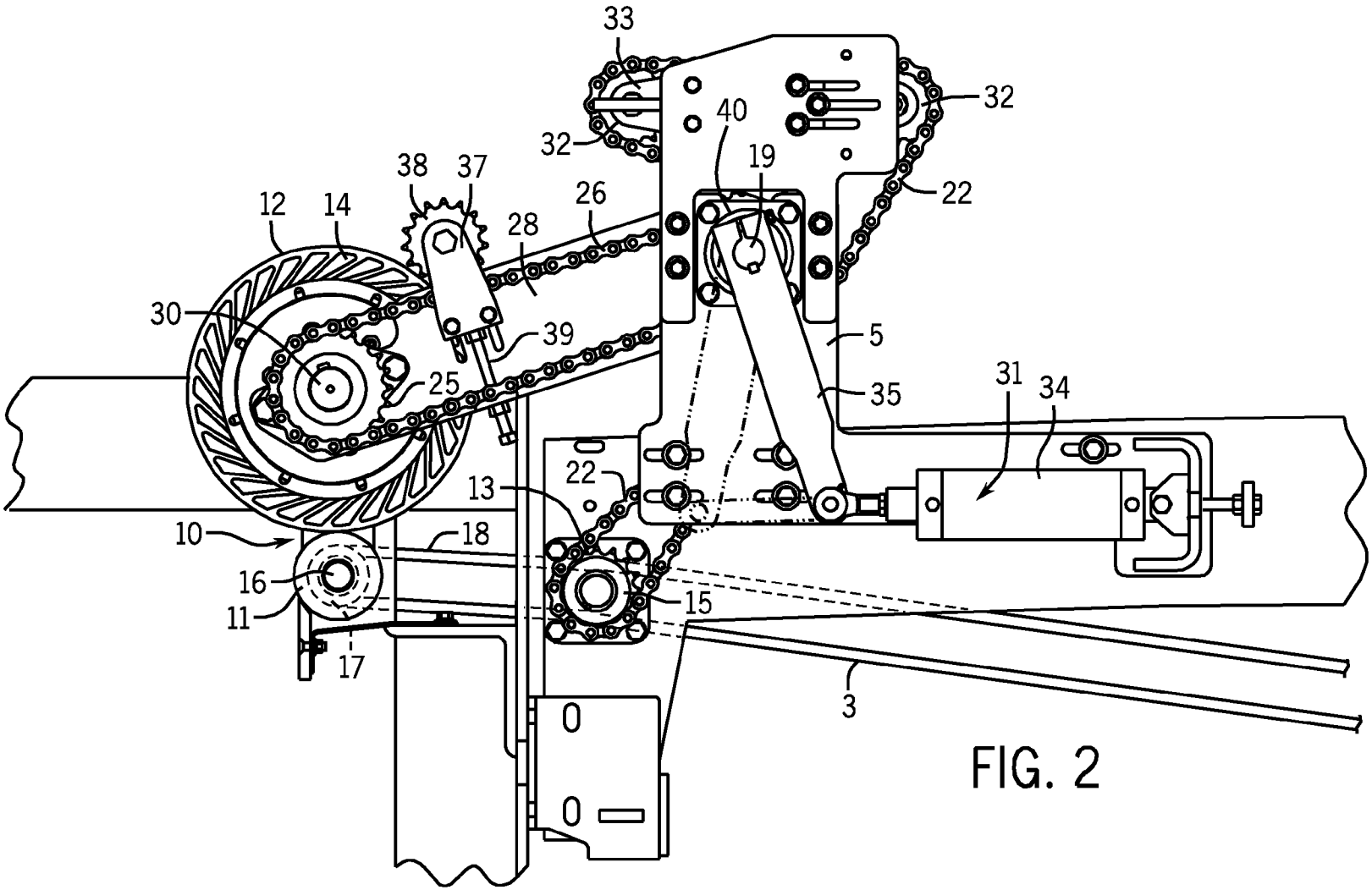
FIG. 2 is an enlarged side elevation of the nip roll drive system.
Figure 3:
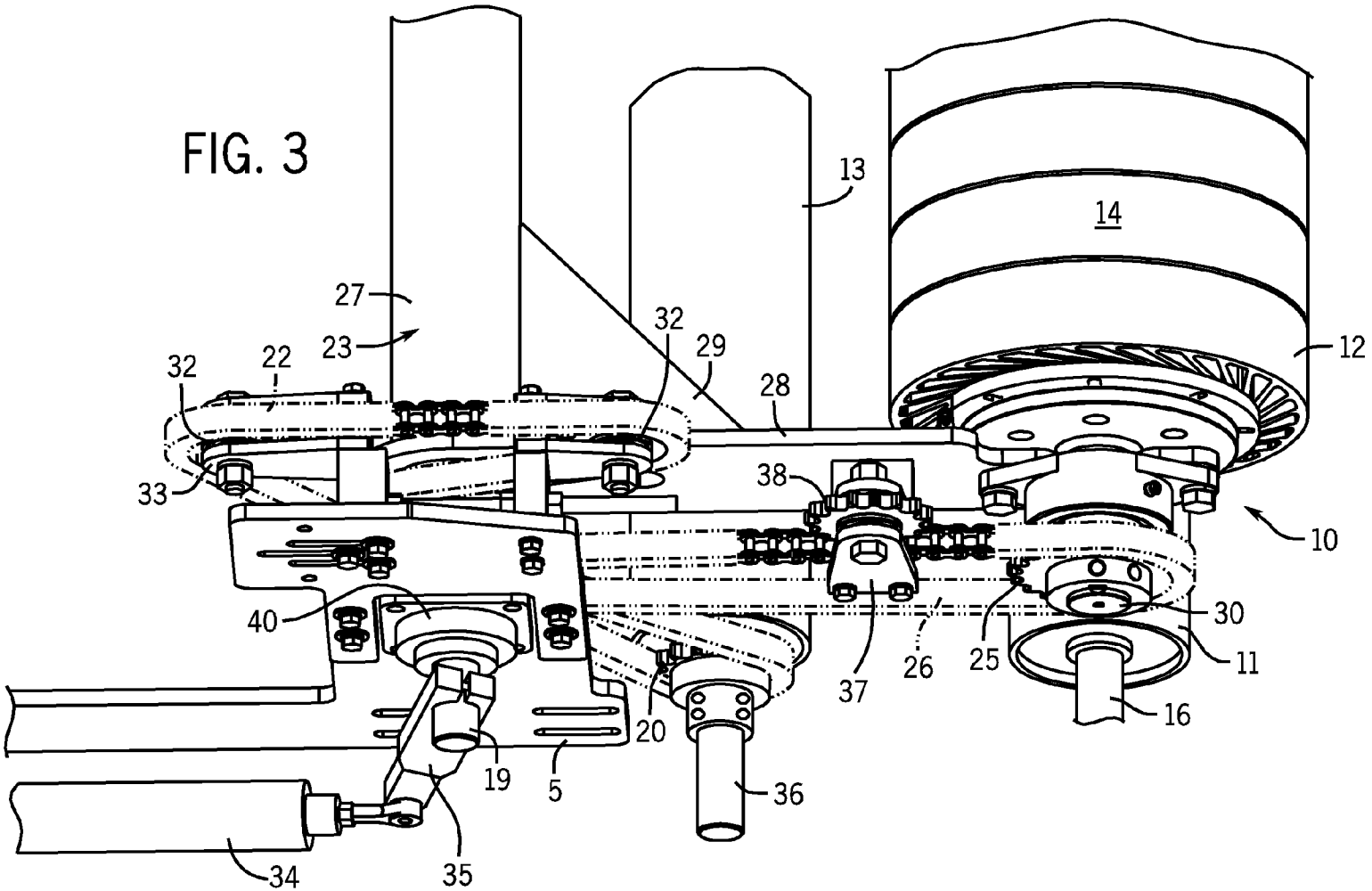
FIG. 3 is a top perspective view of the drive system taken from the opposite side.

As is shown schematically in FIG. 1, the dry end 1 of a corrugator typically includes two downstackers 2, each receiving a stream of shingled sheets from a flat belt conveyor 3 comprising one of a flat belt conveyor system that controls shingle movement and coordinates discharge into one of the downstackers 2, all in a manner well known in the art. Each of the downstackers 2 includes a stacker bay 7 into which the shingled sheets are fed in a stream.

The assembly of a stacker infeed nip 10 is mounted between a pair of side frame members 5 at the upper inlet 6 to a downstacker bay 7 and includes a bottom nip roll 11 and a top nip roll 12, both of which are driven in synchronization by a head pulley 13 of the last flat belt conveyor 3. The bottom nip roll 11 is of conventional construction, as is the larger top nip roll 12 which preferably has a zero crush surface 14. In the prior art, the zero crush top nip roll 12 is simply an idler roll with the zero crush surface that provides normal force on the corrugated sheets being delivered through the nip 10 into the stacker bay 7. An arrangement is typically provided to apply a variable normal force to the zero crush roll and the sheets passing through the nip.

A first driving connection is provided by connecting a head pulley sprocket on one end of the head pulley 13 to a bottom nip roll sprocket 17 mounted on the nip roll shaft 16. The sprockets 15 and 17 are connected by a bottom nip roll drive belt or chain 18 receiving its driving rotation from the head pulley 13. This and the other driving connection may utilize either a steel roller chain or a reinforced rubber timing belt. As used herein, the terms are interchangeable.

A second driving connection is made between a second head pulley sprocket (preferably mounted on the opposite end of the head pulley) and a first idler sprocket 21 mounted for rotation on a stub shaft 19 above the head pulley 13. The driving connection is made by a belt or chain 22. The stub shaft 19 is secured in the end of a tubular member 27 forming part of a support bracket 23 for the top nip roll 12.

A third driving connection is provided between a second idler sprocket 24 rotatably mounted on the stub shaft 19 next to the first idler sprocket 21. The second sprocket 24 is provided with a driving connection to a top nip roll sprocket 25 by a nip roll drive belt or chain 26. Stub shaft 19 is fixed in and provides a pivot axis for the support bracket 23. Idler sprockets 21 and 24 are connected together so that sprocket 24 drives sprocket 25 via chain 26. Sprockets 21 and 24 are journalled together on one of the bearings that ride on stub shafts 19 at opposite ends of the tubular member 27.

The nip roll support bracket 23 includes the tubular member 27 that is coaxial with and carries the stub shafts 19, which are welded to the ends of tubular member 27 to provide the pivot axis.

The support bracket includes a pair of parallel bracket arms 28 rigidly secured to the tubular member 27 and rotatably supporting the top nip roll shaft 30, carrying the top nip roll, at their respective opposite ends. The stub shafts 19 are carried in end bearings 40 attached to the side frame members 5. The nip roll support bracket 23 is strengthened and made more rigid with triangular gussets 29 at the connections of the bracket arms 28 to the tubular member 27.

An actuator arrangement 31 operatively connects the side frame members 5 to the stub shafts 19 to adjust the vertical position and nip force of the top nip roll 12. The actuator arrangement preferably comprises a pair of fluid cylinders, and more preferably, air cylinders 34. The rod ends of the air cylinders 34 are connected to the ends of the stub shafts 19 with pivot arms 35 such that the cylinders operate to move the top nip roll 12 generally vertically with respect to the bottom nip roll 11 to adjust the nip force applied to the shingled sheets pulled through the nip 10. As indicated above, the top nip roll 12 preferably comprises a zero-crush roll 14 to enhance the cushioning effect on the sheets passing through the nip 10.

The first driving connection between the head pulley 13 and the bottom nip roll 11 is positioned on one lateral side of the drive system. The second driving connection between the head pulley 13 and the sprocket 21, and the third driving connection between the sprocket 24 and the top nip roll 12 are positioned adjacent one another on the other lateral side of the drive system.

Figure 4:
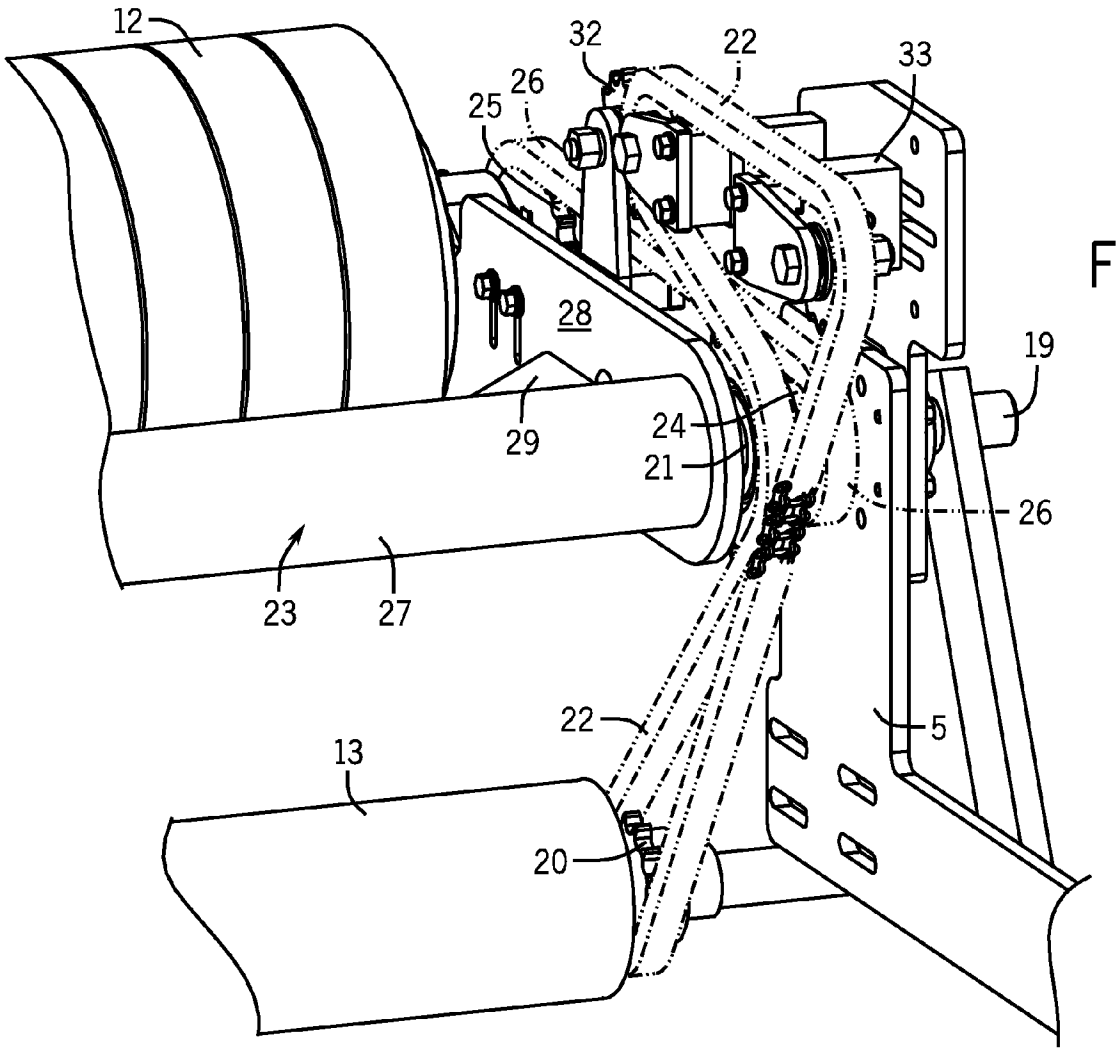
FIG. 4 is a rear perspective view of the system looking in the downstream direction.
Figure 5:
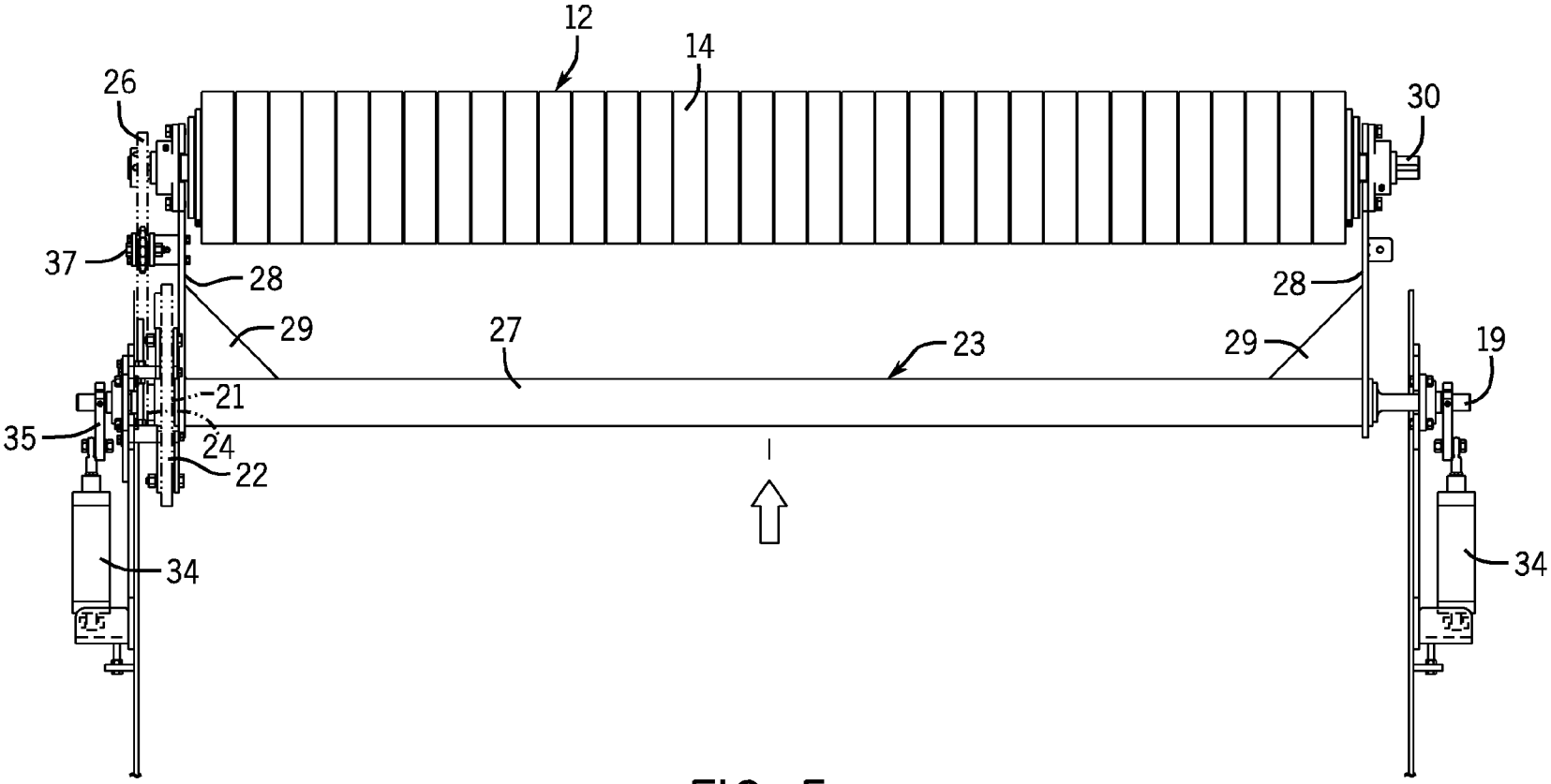
FIG. 5 is a top plan view of the system with the head pulley and bottom nip roll removed.

The second driving connection includes a pair of upper idler sprockets 32 that are mounted on one of the side frame members 5 and horizontally spaced above one end of the stub shaft 19 and around which the chain 22 operates. An adjustable chain tensioner 33 is mounted between the upper idler sprockets 32. As may best be seen in FIG. 4, the chain 22 is back-wrapped around the sprocket 21 to provide a driving connection in a compact assembly and ample room for the top nip roll support bracket 23 and other components of the system.

Tension in the top nip roll drive chain 26 is maintained by a drive belt or chain tensioner 37 that includes a tensioner sprocket 38 mounted to engage the upper run of the drive chain 26 and adjustable vertically by a lower adjustment screw 39 attached to one of the bracket arms 28.

In addition to the improvements in stacker nip performance, the infeed nip 10 uses the same motor driving the flat belt conveyor 3 to drive the bottom and top nip rolls 11 and 12. This provides a significant reduction in cost and improvement in overall reliability.

What is claimed is:

1. In a drive system for feeding a stream of shingled corrugated paperboard sheets on a flat belt conveyor having a driven head pulley to a stacker bay, including a sheet infeed nip defined by a bottom nip roil and a top nip roll, the system comprising:

a first driving connection from the head pulley to a first shaft carrying the bottom nip roll;

a second driving connection from the head pulley to a first idler sprocket rotatably mounted on a second shaft carrying a nip roll support bracket;

a third driving connection from a second idler sprocket rotatably mounted on the second shaft to a third shaft carrying the top nip roll; and, the nip roll support bracket including a tubular member coaxial with and carrying the second shaft, and the idler sprockets journalled in one axial end thereof.

2. The drive system as set forth in claim 1, wherein the head pulley and the first, second and third driving connections are driven by a single motor.

3. The drive system as set forth in claim 1, wherein the first, second and third driving connections comprise respective first, second and third chain and shaft-mounted sprocket drives;

the first driving connection including a head pulley sprocket and a bottom nip roll sprocket connected by a bottom nip roll drive belt;

the second driving connection including a second head pulley sprocket and a first idler sprocket connected by a second drive belt; and the third driving connection including a second idler sprocket and a top nip roll sprocket connected by a top nip roll drive belt.

4. The drive system as set forth in claim 3, including a top nip roll drive chain tensioner positioned between the upper and lower runs of the top nip roll drive chain.

5. The drive system as set forth in claim 1, wherein the top nip roll support bracket is pivotable on the axis of the tubular member.

6. The drive system as set forth in claim 5, wherein the support bracket includes a pair of parallel bracket arms interconnecting the ends of the top nip roll with the respective ends of the second shaft.

7. The drive system as set forth in claim 6, including an actuator arrangement operatively connected to the support bracket to adjust the vertical position and nip force of the top nip roil.

8. The drive system as set forth in claim 7, wherein the actuator arrangement comprises a pair of fluid cylinders connecting the ends of the second shaft with a pair of lever arms.

9. The drive system as set forth in claim 1, wherein the top nip roll comprises a zero-crush roll.

10. The drive system as set forth in claim 1, wherein the second driving connection includes a pair of upper idler tensioning sprockets mounted horizontally spaced above the first idler sprocket, and an adjustable chain tensioner interconnecting the idler sprockets and positioning the second drive chain to back-wrap around the fast idler sprocket.

11. The drive system as set forth in claim 1, wherein the second shaft comprises a stub shaft fixed to each end of the tubular member.

12. The drive system as set forth in claim 11, wherein the first and second idler sprockets are carried on one stub shaft.

13. The drive system as set forth in claim 12, wherein the first and second idler sprockets are joined to rotate together.

* * * * *